US006748905B2

(12) United States Patent
Duncan et al.

(10) Patent No.: US 6,748,905 B2
(45) Date of Patent: Jun. 15, 2004

(54) PROCESS FOR REDUCING ENGINE WEAR IN THE OPERATION OF AN INTERNAL COMBUSTION ENGINE

(75) Inventors: David A. Duncan, Derbyshire (GB); Deborah A. Langer, Chesterland, OH (US); Mayur P. Shah, Hudson, OH (US); Frank V. Zalar, Novelty, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 88 days.

(21) Appl. No.: 10/090,500

(22) Filed: Mar. 4, 2002

(65) Prior Publication Data

US 2003/0164147 A1 Sep. 4, 2003

(51) Int. Cl.[7] ..... F02B 47/00
(52) U.S. Cl. ..... 123/25 E
(58) Field of Search ..... 123/25 E, 25 R, 123/25 C, 25 N, 25 J; 44/301, 302, 325, 326, 629, 639

(56) References Cited

U.S. PATENT DOCUMENTS

| | | | | |
|---|---|---|---|---|
| 3,215,707 A | | 11/1965 | Rense | |
| 3,219,666 A | | 11/1965 | Norman et al. | |
| 3,231,587 A | | 1/1966 | Rense | |
| 3,491,151 A | | 1/1970 | Bader | |
| 3,912,764 A | | 10/1975 | Palmer, Jr. | |
| 3,958,915 A | | 5/1976 | Noda et al. | 431/9 |
| 4,017,512 A | | 4/1977 | Isowa et al. | |
| 4,110,349 A | | 8/1978 | Cohen | |
| 4,234,435 A | * | 11/1980 | Meinhardt et al. | 508/192 |
| 5,731,462 A | | 3/1998 | Calals et al. | |
| 5,733,935 A | | 3/1998 | Andoh et al. | |
| 6,031,130 A | | 2/2000 | Motoki et al. | |
| 6,216,458 B1 | | 4/2001 | Alger | |
| 6,283,096 B1 | | 9/2001 | Kimura | |
| 6,301,887 B1 | | 10/2001 | Gorel et al. | |
| 6,321,537 B1 | | 11/2001 | Coleman et al. | |
| 6,383,237 B1 | * | 5/2002 | Langer et al. | 44/301 |
| 6,530,964 B2 | * | 3/2003 | Langer et al. | 44/301 |
| 2002/0014033 A1 | | 2/2002 | Langer et al. | 44/301 |

FOREIGN PATENT DOCUMENTS

GB 1440219 6/1976

OTHER PUBLICATIONS

Search Report from corresponding International Application No. PCT/US03/05442, date of mailing: Oct. 8, 2003.

* cited by examiner

*Primary Examiner*—Tony M. Argenbright
*Assistant Examiner*—Hyder Ali
(74) *Attorney, Agent, or Firm*—Teresan W. Gilbert; Michael F. Esposito

(57) ABSTRACT

This invention relates to a process for reducing engine wear in the operation of an internal combustion engine, comprising:

(A) recirculating at least part of the exhaust gas from the engine to the intake air supply of the engine; and (B) operating the engine using a water-blended fuel composition made by combining: (i) a normally liquid hydrocarbon fuel; (ii) water; and (iii) at least one surfactant.

15 Claims, 4 Drawing Sheets

PROCESS FOR REDUCING ENGINE WEAR IN THE OPERATION OF AN INTERNAL COMBUSTION ENGINE

TECHNICAL FIELD

This invention relates to a process for reducing engine wear in the operation of an internal combustion engine. More particularly, this invention relates to a process for reducing engine wear in the operation of an internal combustion engine wherein exhaust gas from the engine is recirculated to the intake air supply of the engine, and a water blended fuel is used to operate the engine.

BACKGROUND OF THE INVENTION

Exhaust gas recirculation (EGR) systems are used for controlling the generation of undesirable pollutant gases and particulate matter in the operation of internal combustion engines. These systems have proven useful in internal combustion engines used in motor vehicles such as passenger cars, light duty trucks, and other on-road motor equipment. EGR systems recirculate the exhaust gas into the intake air supply of the internal combustion engine. The exhaust gas which is reintroduced to the engine cylinder reduces the concentration of oxygen therein, which in turn lowers the maximum combustion temperature within the cylinder and slows the chemical reaction of the combustion process, decreasing the formation of $NO_x$. The exhaust gases typically contain unburned hydrocarbons that are burned on reintroduction into the engine cylinder, which further reduces the emission of exhaust gas by-products that would be emitted as undesirable pollutants from the internal combustion engine.

A problem with the use of EGR systems is that the exhaust gas that is recirculated tends to be highly acidic. This results in premature wear of engine parts. This problem has been overcome with the present invention that involves operating the engine using a water blended fuel composition.

SUMMARY OF THE INVENTION

This invention relates to a process for reducing engine wear in the operation of an internal combustion engine, comprising:

(A) recirculating at least part of the exhaust gas from the engine to the intake air supply of the engine; and (B) operating the engine using a water-blended fuel composition made by combining:

(i) a normally liquid hydrocarbon fuel;

(ii) water; and (iii) at least one surfactant comprising:

(iii)(a) at least one product made from the reaction of an acylating agent with ammonia, an amine, a hydroxyamine, an alcohol, or a mixture of two or more thereof;

(iii)(b) at least one product derived from: a polycarboxylic acylating agent; a copolymer derived from at least one olefin monomer and at least one alpha, beta unsaturated carboxylic acid or derivative thereof; and a linking compound having two or more primary amino groups, two or more secondary amino groups, at least one primary amino group and at least one secondary amino group, at least two hydroxyl groups, or at least one primary or secondary amino group and at least one hydroxyl group;

(iii)(c) at least one Mannich reaction product derived from a hydroxy aromatic compound, an aldehyde or a ketone, and an amine containing at least one primary or secondary amino group;

(iii)(d) at least one ionic or a nonionic compound having a hydrophilic-lipophilic balance of about 1 to about 40; or (iii)(e) mixture of two or more of (iii)(a) through (iii)(d).

In addition to reducing engine wear, additional advantages of using the inventive process involve reducing the generation of $NO_x$ and particulate emissions in the exhaust of the engine. In at least one embodiment of the invention, the engine wear reduction that is achieved is comprised of piston ring wear reduction and/or cylinder liner wear reduction.

DETAILED DESCRIPTION OF THE INVENTION

Figure 1:
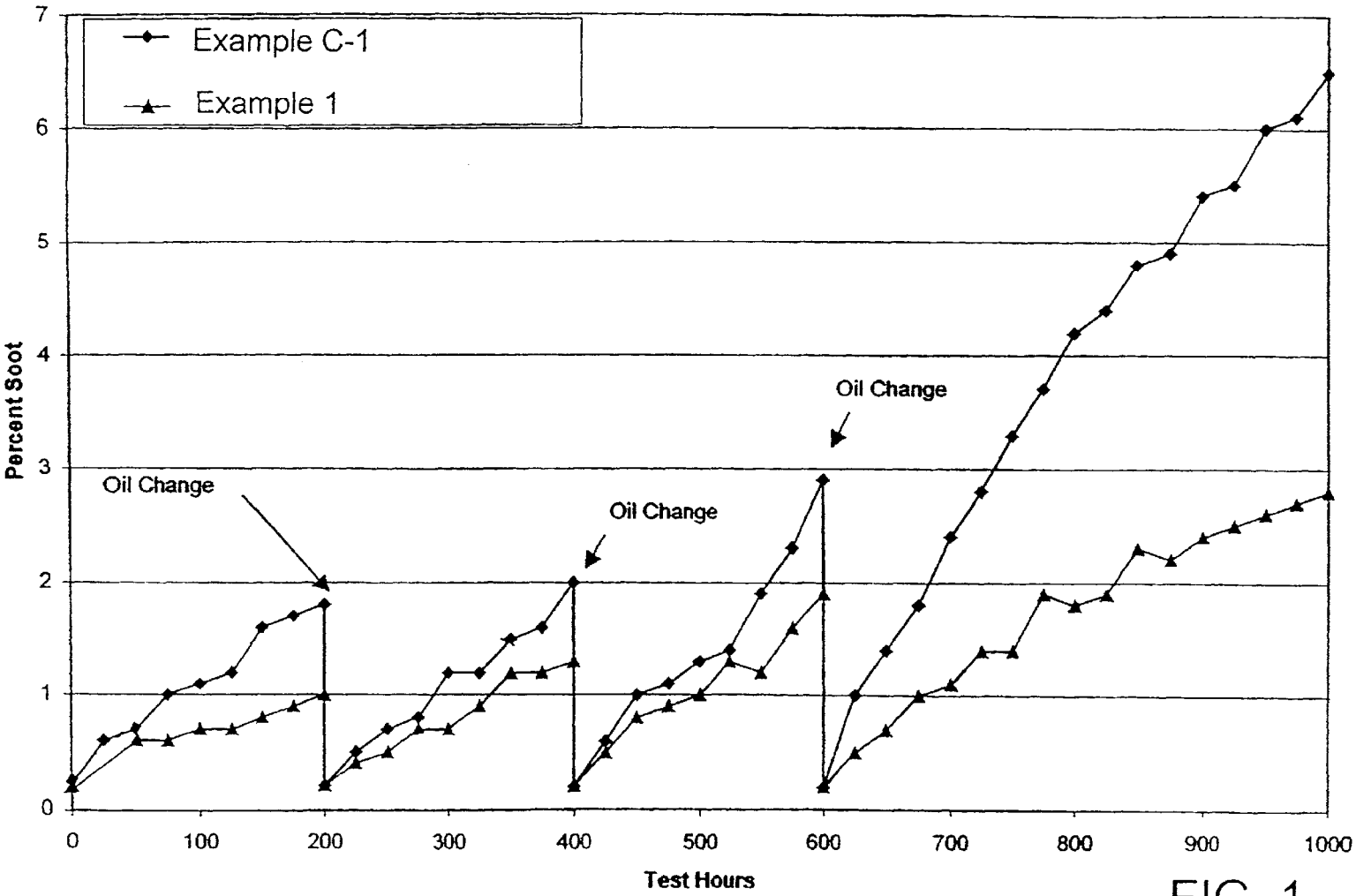
FIG. 1 is a plot of percent soot in the lubricant versus test hours for the engine tests reported in Examples 1 and C-1.

The terms "hydrocarbon," "hydrocarbyl," and "hydrocarbon-based," when referring to groups attached to the remainder of a molecule, refer to groups having a purely hydrocarbon or predominantly hydrocarbon character within the context of this invention. Such groups include the following:

(1) Purely hydrocarbon groups; that is, aliphatic, alicyclic, aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Examples include methyl, octyl, cyclohexyl, phenyl, etc.

(2) Substituted hydrocarbon groups; that is, groups containing non-hydrocarbon substituents that do not alter the predominantly hydrocarbon character of the group. Examples include hydroxy, nitro, cyano, alkoxy, acyl, etc.

(3) Hetero groups; that is, groups which, while predominantly hydrocarbon in character, contain atoms other than carbon in a chain or ring otherwise composed of carbon atoms. Examples include nitrogen, oxygen and sulfur.

In general, no more than about three substituents or hetero atoms, and in one embodiment no more than one, will be present for each 10 carbon atoms in the hydrocarbon, hydrocarbyl or hydrocarbon-based group.

The term "lower" as used herein in conjunction with terms such as hydrocarbon, alkyl, alkenyl, alkoxy, and the like, is intended to describe such groups which contain a total of up to 7 carbon atoms.

The term "hydroxyamine" refers to an amine containing at least one —OH group attached to any carbon atom or nitrogen atom in the molecule. These include aminoalcohols that are also known as alkanolamines.

The term "oil-soluble" refers to a material that is soluble in mineral oil to the extent of at least about 0.5 gram per liter at 25° C.

The term "water-soluble" refers to materials that are soluble in water to the extent of at least 0.5 gram per 100 milliliters of water at 25° C.

The Internal Combustion Engine

The internal combustion engine that may be operated in accordance with the invention may be any internal combustion engine that contains equipment for recirculating at least part, and in one embodiment all of its exhaust gas into the intake air supply of the engine. The internal combustion engines include spark-ignited and compression-ignited internal combustion engines, including automobile and truck engines, two-cycle engines, aviation piston engines, marine and railroad diesel engines, and the like. Included are on and off-highway engines. The compression ignited (or diesel) engines include those for both mobile and stationary power plants. The diesel engines include those used in urban buses, as well as all classes of trucks. The diesel engines may be of the two-stroke per cycle or four-stroke per cycle type. The diesel engines include heavy duty diesel engines. The equipment for recirculating the exhaust gas includes EGR systems known in the art. Examples are disclosed in U.S. Pat. Nos. 6,216,458 B1; 6,283,096 B1; 6,301,887 B1; and 6,321,537 B1, incorporated herein by reference.

The Water Blended Fuel Composition

The water blended fuel composition may be comprised of (i) a normally liquid hydrocarbon fuel, (ii) water, and (iii) at least one surfactant, and optionally additional additives as needed, including water soluble nitrogen containing emulsion stabilizers, cetane improvers, antifreeze agents, combustion improvers, organic solvents, and the like.

The water blended fuel may be in the form of a water-in-oil emulsion or a micro-emulsion. Throughout the specification and in the claims the term "oil" (as in water-in-oil emulsion) is sometimes used to refer to the hydrocarbon fuel phase of the water blended fuel composition. In one embodiment, the water blended fuel composition is characterized by a dispersed aqueous phase, the dispersed aqueous phase being comprised of droplets having a mean diameter of about 0.05 to about 50 microns, and in one embodiment about 0.05 to about 30 microns, and in one embodiment about 0.05 to about 10 microns, and in one embodiment about 0.05 to about 3 microns, and in one embodiment, 0.05 to about 1 micron, and in one embodiment about 0.05 to about 0.9 micron, and in one embodiment about 0.05 to about 0.8 micron, and in one embodiment about 0.5 to about 0.8 microns.

The Normally Liquid Hydrocarbon Fuel (i)

The normally liquid hydrocarbon fuel may be a hydrocarbonaceous petroleum distillate fuel such as motor gasoline as defined by ASTM Specification D439 or diesel fuel or fuel oil as defined by ASTM Specification D396. Normally liquid hydrocarbon fuels comprising non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid hydrocarbon fuels that are mixtures of one or more hydrocarbonaceous fuels and one or more non-hydrocarbonaceous materials are also contemplated. Examples of such mixtures are combinations of gasoline and ethanol, or diesel fuel and ether.

The normally liquid hydrocarbon fuel is present in the water-blended fuel composition at a concentration of about 50 to about 95% by weight, and in one embodiment about 60 to about 95% by weight, and in one embodiment about 75% to about 85% by weight.

The Water (ii)

The water may be taken from any convenient source. In one embodiment, the water is deionized. In one embodiment, the water is purified using reverse osmosis or distillation.

The water may be present in the water blended fuel at a concentration of about 5 to about 50% by weight, and in one embodiment about 5 to about 40% by weight, and in one embodiment about 15 to about 25% by weight.

The Surfactant (iii)

The surfactant (iii) may function as an emulsifier and may be referred to as an emulsifier. The surfactant (iii) may be one or more of any of the surfactants (iii)(a) to (iii)(d) referred to above and discussed below. The concentration of the surfactant (iii) in the water blended fuel composition may range from about 0.01 to about 20% by weight, and in one embodiment about 0.05 to about 10% by weight, and in one embodiment about 0.1 to about 5% by weight.

Surfactant (iii)(a)

The surfactant (iii)(a) may be one or more products made by reacting one or more acylating agents with one or more of ammonia, an amine, a hydroxyamine, or an alcohol. The acylating agent may be one or more carboxylic acids or reactive equivalents thereof. The carboxylic acids may be monobasic or polybasic. The polybasic acids include dicarboxylic acids, although tricarboxylic and tetracarboxylic acids may be used. The reactive equivalents may be acid halides, anhydrides or esters, including partial esters, and the like.

The acylating agent may be a carboxylic acid or reactive equivalent thereof having about 10 to about 34 carbon atoms, and in one embodiment about 12 to about 24 carbon atoms. These acylating agents may be monobasic acids, polybasic acids, or reactive equivalents of such mono- or polybasic acids. These include fatty acids. Examples include lauric acid, myristic acid, palmitic acid, stearic acid, isostearic acid, oleic acid, linoleic acid, linolenic acid, arachidic acid, behenic acid, erucic acid, lignoceric acid, tall oil acid, coconut oil fatty acid, and the like. Dimers and trimers of the foregoing may be used. The polybasic acids may be dicarboxylic, although tricarboxylic or tetracarboxylic acids may be used. These include hydrocarbon substituted succinic acids or anhydrides wherein the hydrocarbon substituent has from about 6 to about 30 carbon atoms, and in one embodiment about 12 to about 24 carbon atoms.

The acylating agent may be a hydrocarbon substituted carboxylic acid or reactive equivalent made by reacting one or more alpha, beta olefinically unsaturated carboxylic acid reagents containing 2 to about 20 carbon atoms, exclusive of the carboxyl groups, with one or more olefin polymers. The olefin polymers may contain about 30 to about 500 carbon atoms, and in one embodiment about 50 to about 500 carbon atoms.

The alpha-beta olefinically unsaturated carboxylic acid reagents may be either monobasic or polybasic in nature. Exemplary of the monobasic alpha-beta olefinically unsaturated carboxylic acid reagents include the carboxylic acids corresponding to the formula

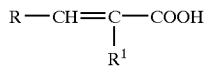

wherein R is hydrogen, or a saturated aliphatic or alicyclic, aryl, alkylaryl or heterocyclic group, and $R^1$ is hydrogen or a lower alkyl group. R may be a lower alkyl group. The total number of carbon atoms in R and $R^1$ typically does not exceed about 18 carbon atoms. Examples include acrylic acid; methacrylic acid; cinnamic acid; crotonic acid; 3-phenyl propenoic acid; alpha, and beta-decenoic acid. The polybasic acid reagents may be dicarboxylic, although tri- and tetracarboxylic acids can be used. Examples include maleic acid, fumaric acid, mesaconic acid, itaconic acid and citraconic acid. Reactive equivalents include the anhydride, ester or amide functional derivatives of the foregoing acids. A useful reactive equivalent is maleic anhydride.

The olefin monomers from which the olefin polymers may be derived are polymerizable olefin monomers characterized by having one or more ethylenic unsaturated groups. They can be monoolefinic monomers such as ethylene, propylene, butene-1, isobutene and octene-1, or polyolefinic monomers (usually di-olefinic monomers such as butadiene-1,3 and isoprene). Usually these monomers are terminal olefins, that is, olefins characterized by the presence of the group>C=$CH_2$. However, certain internal olefins can also serve as monomers (these are sometimes referred to as medial olefins). When such medial olefin monomers are used, they normally are employed in combination with terminal olefins to produce olefin polymers that are interpolymers. The olefin polymers may include aromatic groups and alicyclic groups. These include olefin polymers derived from such interpolymers of both 1,3-dienes and styrenes such as butadiene-1,3 and styrene or para-(tertiary butyl) styrene.

Generally the olefin polymers are homo- or interpolymers of terminal hydrocarbon olefins of about 2 to about 30 carbon atoms, and in one embodiment about 2 to about 16 carbon atoms, and in one embodiment about 2 to about 6 carbon atoms, and in one embodiment 2 to about 4 carbon atoms.

In one embodiment, the olefin polymers are polyisobutenes (or polyisobutylenes) such as those obtained by polymerization of a $C_4$ refinery stream having a butene content of about 35 to about 75% by weight and an isobutene content of about 30 to about 60% by weight in the presence of a Lewis acid catalyst such as aluminum chloride or boron trifluoride. These polyisobutenes generally contain predominantly (that is, greater than about 50 percent of the total repeat units) isobutene repeat units.

The olefin polymer may be a polyisobutene having a high methylvinylidene isomer content, that is, at least about 50% by weight, and in one embodiment at least about 70% by weight methylvinylidenes. Suitable high methylvinylidene polyisobutenes include those prepared using boron trifluoride catalysts.

The acylating agent may be a hydrocarbon-substituted (e.g., polyisobutene substituted) succinic acid or anhydride wherein the hydrocarbon substituent has from about 30 to about 500 carbon atoms, and in one embodiment from about 50 to about 500 carbon atoms. The hydrocarbon substituent may have a number average molecular weight of about 750 to about 3000, and in one embodiment about 900 to about 2000. In one embodiment, the number average molecular weight is from about 750 to about 1500, and in one embodiment it is from about 1500 to about 3000.

In one embodiment, the hydrocarbon-substituted succinic acids or anhydrides are characterized by the presence within their structure of an average of at least about 1.3 succinic groups, and in one embodiment from about 1.5 to about 2.5, and in one embodiment form about 1.7 to about 2.1 succinic groups for each equivalent weight of the hydrocarbon substituent. The ratio of succinic groups to equivalent of substituent groups present in the hydrocarbon-substituted succinic acylating agent (also called the "succination ratio") can be determined by one skilled in the art using conventional techniques (such as from saponification or acid numbers). This is described in U.S. Pat. No. 4,234,435, which is incorporated herein by reference.

The conditions for reacting the alpha, beta olefinically unsaturated carboxylic acid reagent with the olefin polymer are known to those in the art. Examples of patents describing various procedures for preparing useful acylating agents include U.S. Pat. Nos. 3,215,707; 3,219,666; 3,231,587; 3,912,764; 4,110,349; and 4,234,435; and U.K. Patent 1,440,219. The disclosures of these patents are hereby incorporated by reference.

The acylating agent may be a linked compound comprised of (I) a first polycarboxylic acylating agent having at least one hydrocarbon substituent of about 6 to about 500 carbon atoms (e.g., about 50 to about 500 carbon atoms), and (II) a second polycarboxylic acylating agent optionally having at least one hydrocarbon substituent of up to about 500 carbon atoms (e.g., about 12 to about 500 carbon atoms) linked together by a linking group (III). The acylating agents (I) and (II) may be the same or they may be different. The linking group is derived from a compound having two or more primary amino groups, two or more secondary amino groups, at least one primary amino group and at least one secondary amino group, at least two hydroxyl groups, or at least one primary or secondary amino group and at least one hydroxyl groups. The weight ratio of (I):(II) may be from about 5:95 to about 95:5, and in one embodiment about 25:75 to about 75:25.

The linking group (III) for linking the first acylating agent (I) with the second acylating agent (II) may be derived from a polyol, a polyamine or a hydroxyamine. The polyols may be represented by the formula $$R—(OH)_m$$

wherein in the foregoing formula, R is an organic group having a valency of m, R is joined to the OH groups through carbon-to-oxygen bonds, and m is an integer from 2 to about 10, and in one embodiment 2 to about 6. R may be a hydrocarbon group of 1 to about 40 carbon atoms, and in one embodiment 1 to about 20 carbon atoms. The polyol may be a glycol. The alkylene glycols are useful. Examples of the polyols that may be used include ethylene glycol, diethylene glycol, triethylene glycol, 1,2-butanediol, and the like.

The polyamines may be aliphatic, cycloaliphatic, heterocyclic or aromatic compounds. The polyamines may be hydroxyalkyl alkylene polyamines. The alkylene polyamines may be represented by the formula:

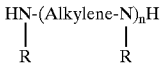

wherein n has an average value between 1 and about 14, and in one embodiment about 2 to about 10, and in one embodiment about 2 to about 7, the "Alkylene" group has from 1 to about 10 carbon atoms, and in one embodiment about 2 to about 6 carbon atoms, and each R is independently hydrogen, an aliphatic or hydroxy-substituted aliphatic group of up to about 30 carbon atoms. These alkylene polyamines include methylene polyamines, ethylene polyamines, diethylene triamine, butylene polyamines, propylene polyamines, pentylene polyamines, etc. Specific examples of such polyamines include ethylene diamine, diethylene triamine, triethylene tetramine, tetraethylene pentamine, pentaethylene hexamine, hexaethylene heptamine, propylene diamine, trimethylene diamine, tripropylene tetramine, N-(2-hydroxyethyl) ethylene diamine, and the like.

The hydroxyamines may be primary or secondary amines. In one embodiment, the hydroxyamine is (a) an N-(hydroxyl-substituted hydrocarbon) amine, (b) a hydroxyl-substituted poly(hydrocarbonoxy) analog of (a), or a mixture of (a) and (b). The hydroxyamine may be an alkanol amine containing from 1 to about 40 carbon atoms, and in one embodiment 1 to about 20 carbon atoms, and in one embodiment 1 to about 10 carbon atoms. These include primary amines, secondary amines, and mixtures thereof.

The hydroxyamine may be a hydroxy-substituted primary amine represented by the formula $$R_a—NH_2$$

wherein $R_a$ is a monovalent organic group containing at least one alcoholic hydroxy group. The total number of carbon atoms in $R_a$ may be from 1 to about 20., and in one embodiment 1 to about 10. The polyhydroxy-substituted alkanol primary amines wherein there is only one amino group present (i.e., a primary amino group) having one alkyl substituent containing 1 to about 10 carbon atoms, and 1 to about 6 hydroxyl groups are useful.

The linked acylating agents may be formed by reacting the acylating agents (I) and (II) with the linking compound (III) under ester and/or amide-forming conditions. This normally involves heating acylating agents (I) and (II) with the linking compound (III), optionally in the presence of a normally liquid, substantially inert, organic liquid solvent/diluent. Temperatures of at least about 30° C. up to the decomposition temperature of the reaction component and/or product having the lowest such temperature can be used. This temperature may be in the range of about 50° C. to about 250° C. The ratio of reactants may be varied over a wide range. Generally, for each equivalent of each of the acylating agents (I) and (II), at least about one equivalent of the linking compound (III) is used. The upper limit of linking compound (III) is about 2 equivalents of linking compound (III) for each equivalent of acylating agents (I) and (II). Generally the ratio of equivalents of acylating agent (I) to the acylating agent (II) is about 0.5 to about 2, with about 1:1 being useful. The product made by this reaction may be in the form of statistical mixture that is dependent on the charge of each of the acylating agents (I) and (II), and on the number of reactive sites on the linking compound (III). For example, if an equal molar ratio of acylating agents (I) and (II) is reacted with ethylene glycol, the product would be comprised of a mixture of (1) 50% of compounds wherein one molecule the acylating agent (I) is linked to one molecule of the acylating agent (II) through the ethylene glycol; (2) 25% of compounds wherein two molecules of the acylating agent (I) are linked together through the ethylene glycol; and (3) 25% of compounds wherein two molecules of the acylating agent (II) are linked together through the ethylene glycol.

The amines, alcohols and hydroxyamines that are useful for reacting with the acylating agent to form the surfactant (iii)(a) include the amines, alcohols and hydroxyamines discussed above as being useful as linking compounds. Also included are primary and secondary monoamines, tertiary mono- and polyamines, mono-alcohols, and tertiary alkanol amines. The tertiary amines are analogous to the primary amines, secondary amines and hydroxyamines discussed above with the exception that they may be either monoamines or polyamines and the hydrogen atoms in at least one of the H—N< or —$NH_2$ groups are replaced by hydrocarbon groups.

The monoamines that are useful for reacting with the acylating agent to form the surfactant (iii)(a) may be represented by the formula

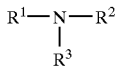

wherein $R^1$, $R^2$ and $R^3$ are the same or different hydrocarbon groups. $R^1$, $R^2$ and $R^3$ may be hydrocarbon groups of from 1 to about 20 carbon atoms, and in one embodiment from 1 to about 10 carbon atoms. Examples of useful tertiaryamines include trimethylamine, tributylamine, monomethyldiethylamine, dimethylpentylamine, and the like.

Tertiary alkanol amines that are useful for reacting with the acylating agent to form the surfactant (iii)(a) include those represented by the formulae:

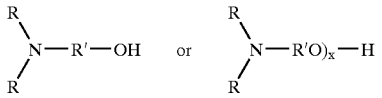

wherein each R is independently a hydrocarbon group of 1 to about 8 carbon atoms or hydroxyl-substituted hydrocarbon group of 2 to about 8 carbon atoms and R' is a divalent hydrocarbon group of about two to about 18 carbon atoms, and x is a number from 2 to about 15. Examples include dimethylethanol amine and diethylethanol amine.

Polyamines that are useful for reacting with the acylating agent to form the surfactant (iii)(a) include the alkylene polyamines discussed above as well as alkylene polyamines with only one or no hydrogens attached to the nitrogen atoms.

The amines useful for reacting with the acylating agent to form the surfactant (iii)(a) include heavy polyamines. The term "heavy polyamine" refers to a polyamine having seven or more nitrogens per molecule and two or more primary amines per molecule. The heavy polyamines typically comprise mixtures of ethylene polyamines. They often result from the stripping of polyamine mixtures, to remove lower molecular weight polyamines and volatile components, to leave, as residue, what is often termed "polyamine bottoms." In general, polyamine bottoms may be characterized as having less than about 2% by weight material boiling below about 200° C.

The mono-alcohols that are useful for reacting with the acylating agent to form the surfactant (iii)(a) may contain from 1 to about 40 carbon atoms, and in one embodiment 1 to about 20 carbon atoms. Examples include methyl alcohol, ethyl alcohol, secondary butyl alcohol, isobutyl alcohol, cyclopentanol, and the like. The mono-alcohols also include the alcohols represented by the formula $$RO(R^1O)_nH$$

wherein R is hydrogen or a hydrocarbon group of 1 to about 40 carbon atoms, and in one embodiment 1 to about 20 carbon atoms; $R^1$ is an alkylene group of 1 to about 6 carbon atoms, and in one embodiment about 2 to about 4 carbon atoms; and n is a number in the range of about 1 to about 30, and in one embodiment about 6 to about 30. R may be a straight chain or branched chain alkyl or alkenyl group. $R^1$ may be a $C_2$, $C_3$ or $C_4$ alkylene group, or a mixture of two or more thereof.

The surfactant (iii)(a) may be in the form of a salt, an ester, an amide, an imide or a mixture (e.g., ester/salt) of two or more thereof. The reaction between the acylating agent and the ammonia, amine, hydroxyamine, alcohol or mixture thereof to form the surfactant (iii)(a) may be carried out under conditions that provide for the formation of the desired product. Typically, the reaction is carried out at a temperature in the range of from about 50° C. to about 250° C.; optionally in the presence of a normally liquid, substantially inert organic liquid solvent/diluent, until the desired product has formed. In one embodiment, the acylating agent and the ammonia, amine, hydroxyamine, alcohol, or mixture thereof, are reacted in amounts sufficient to provide from about 0.3 to about 3 equivalents of acylating agent per equivalent of ammonia, amine, hydroxyamine, alcohol, or mixture thereof. In one embodiment, this ratio is from about 0.5:1 to about 2:1.

In one embodiment, the surfactant (iii)(a) may be prepared by initially reacting the acylating agents (I) and (II) with the linking compound (III) to form a linked acylating agent, and thereafter reacting the linked acylating agent with the ammonia, amine, hydroxyamine, alcohol, or mixture thereof, to form the desired product. An alternative method involves reacting the acylating agent (I) and ammonia, amine, hydroxyamine, alcohol, or mixture thereof, with each other to form a first intermediate product, separately reacting the acylating agent (II) and ammonia, amine, hydroxyamine, alcohol, or mixture thereof (which can be the same or different ammonia, amine, hydroxyamine, alcohol, or mixture thereof that is reacted with the acylating agent (I)) with each other to form a second intermediate product, then reacting a mixture of these two products with the linking compound (III).

The number of equivalents of the acylating agents depends on the total number of carboxylic functions present that are capable of reacting as a carboxylic acid acylating agent. For example, there would be two equivalents in an anhydride derived from the reaction of one mole of olefin polymer and one mole of maleic anhydride.

The weight of an equivalent of ammonia or a monoamine is equal to its molecular weight. The weight of an equivalent of a polyamine is the molecular weight of the polyamine divided by the total number of nitrogens present in the molecule. If the amine is to be used as linking compound (III), tertiary amino groups are not counted. On the other hand, if the amine is used in the reaction with the acylating agent to form the surfactant (iii)(a), tertiary amino groups are counted. The weight of an equivalent of a commercially available mixture of polyamines can be determined by dividing the product of 100 times the atomic weight of nitrogen (14), that is 1400, by the % N contained in the polyamine.

The weight of an equivalent of an alcohol is its molecular weight divided by the total number of hydroxyl groups present in the molecule. Thus, the weight of an equivalent of ethylene glycol is one-half its molecular weight.

The weight of an equivalent of a hydroxyamine used as a linking compound (ill) is equal to its molecular weight divided by the total number of —OH, >NH and —$NH_2$ groups present in the molecule. If the hydroxyamine is to be used in the reaction with the acylating agent to form the surfactant (iii)(a), then tertiary amino groups are also counted.

In one embodiment, the surfactant (iii)(a) is comprised of a mixture of: (A) the reaction product (e.g., salt) of a fatty acid (e.g., oleic acid) with an alkanol amine (e.g., diethylethanol amine); and (B) the reaction product (e.g., di-salt) of a polyisobutene (Mn=about 500 to about 3000) substituted succinic acid or anhydride with an alkanol amine (e.g., diethylethanol amine). The weight ratio of (A) to (B) may range from about 3:1 to about 1:3.

In one embodiment, the surfactant (iii)(a) is comprised of a mixture of: the reaction product (e.g., ester/salt) of a polyisobutene (Mn=about 1500 to about 3000) substituted succinic acid or anhydride with an alkanol amine (e.g., dimethylethanol amine); the reaction product (e.g., imide) of a polyisobutene (Mn=about 750 to about 1500) substituted succinic acid or anhydride with an alkylene polyamine (e.g., ethylene polyamine mixture containing diethylene triamine and heavy polyamines); and the reaction product (e.g., ester/salt) of a hydrocarbon (about 12 to about 30 carbon atoms) substituted succinic acid or anhydride with an alkanol amine (e.g., N,N-dimethylethanol amine).

Surfactant (iii)(b)

The surfactant (iii)(b) is comprised of (A) a polycarboxylic acylating agent, and (B) a copolymer derived from at least one olefin monomer and at least one alpha, beta unsaturated carboxylic acid or derivative thereof. The acylating agent (A) and copolymer (B) are linked together by (C) a linking group derived from a compound having two or more primary amino groups, two or more secondary amino groups, at least one primary amino group and at least one secondary amino group, at least two hydroxyl groups, or at least one primary or secondary amino group and at least one hydroxyl group.

The polycarboxylic acylating agent (A) is a polycarboxylic acid or reactive equivalent thereof. These polycarboxylic acylating agents may be the same as the polycarboxylic acylating agents described above in the description of the surfactant (iii)(a).

The alpha-beta olefinically unsaturated carboxylic acids or derivatives thereof used in making the copolymer (B) may be the same as the alpha, beta olefinically unsaturated carboxylic acid reagents described above in the description of the surfactant (iii)(a).

The olefin monomers used in making the copolymer (B) may be the same as olefin monomers described above in the description of the surfactant (iii)(a).

In one embodiment, the copolymer (B) is a copolymer of styrene and maleic anhydride, and in one embodiment it is a copolymer of octadecene-1 and maleic anhydride.

The copolymer (B) may be prepared by reacting the olefin monomer with the alpha, beta olefinically unsaturated carboxylic or derivative in the presence of a dialkyl peroxide (e.g., di-t-butyl peroxide) initiator. This is disclosed in British Patent 1,121,464, incorporated herein by reference. The molar ratio of olefin monomer to alpha, beta unsaturated carboxylic acid or derivative may range from about 2:1 to about 1:2, and in one embodiment it is about 1:1. The copolymer (II) may have a number average molecular weight in the range of about 2000 to about 50,000, and in one embodiment about 5,000 to about 30,000.

The linking group (C) for linking the acylating agent (A) with the copolymer (B) may be any of the linking compounds (III) described above in the description of the surfactant (iii)(a) for linking the acylating agent (I) with the acylating agent (II).

The acylating agent (A) and copolymer (B) may be reacted with the linking compound (C) according to conventional ester and/or amide-forming techniques. Alternatively, the linking compound (C) may be reacted with either the acylating agent (A) or copolymer (B) to form an intermediate compound, and then the intermediate compound is reacted with the remaining non-reacted acylating agent (A) or copolymer (B). These reactions involve heating the reactants, optionally in the presence of a normally liquid, substantially inert, organic liquid solvent/diluent. Temperatures of at least about 30° C. up to the decomposition temperature of the reaction component and/or product having the lowest such temperature may be used. The temperature may be in the range of about 50° C. to about 260° C.

The ratio of reactants may be varied over a wide range. Generally, for each equivalent of each of the acylating agent (A) and copolymer (B), at least about one equivalent of the linking compound (C) is used. The upper limit of linking compound (C) is about 2 equivalents of linking compound (C) for each equivalent of acylating agent (A) and copolymer (B). Generally the ratio of equivalents of acylating agent (A) to copolymer (B) is about 0.5:1 to about 2:1, with about 1:1 being useful.

The number of equivalents of the acylating agent (A) and copolymer (B) depends on the total number of carboxylic functions present in each. In determining the number of equivalents for the acylating agent (A) and copolymer (B), those carboxyl functions that are not capable of reacting with the linking compound (C) are excluded. In general, however, there is one equivalent of each acylating agent (A) and copolymer (B) for each carboxyl group in the acylating agent (A) and copolymer (B). The number of equivalents for the linking compound (C) is determined in the same manner as for the linking compounds (III) used to make the surfactant (iii)(a).

Surfactant (iii)(c)

The surfactant (iii)(c) is at least one Mannich reaction product derived from a hydroxy aromatic compound, an aldehyde or a ketone, and an amine containing at least one primary or secondary amino group. The hydroxy aromatic compound may be represented by the formula (iii)(c)-1

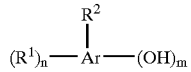

wherein in Formula (iii)(c)-1: Ar is an aromatic group; m is 1, 2 or 3; n is a number from 1 to about 4; with the proviso that the sum of m and n is less than the number of available positions on Ar that can be substituted; each $R^1$ independently is a hydrocarbon group of up to about 400 carbon atoms; and $R^2$ is H, amino or carboxy.

In Formula (iii)(c)-1, Ar may be a benzene or a naphthalene nucleus. Ar may be a coupled aromatic compound. The coupling atom or group may be O, S, $CH_2$, a lower alkylene group having from 1 to about 6 carbon atoms, NH, and the like, with $R^1$ and OH generally being pendant from each aromatic nucleus. Examples of specific coupled aromatic compounds include diphenylamine, diphenylmethylene and the like. m is usually from 1 to about 3, and in one embodiment 1 or 2, and in one embodiment 1. n is usually from 1 to about 4, and in one embodiment 1 or 2, and in one embodiment 1. $R^2$ may be H, amino or carboxyl. $R^1$ may be a hydrocarbon group of up to about 400 carbon atoms, and in one embodiment up to about 250 carbon atoms, and in one embodiment up to about 150 carbon atoms. $R^1$ may be an alkyl group, alkenyl group or cycloalkyl group.

In one embodiment, $R^1$ is a hydrocarbon group derived from an olefin polymer. The olefin polymer may be any of the olefin polymers described above in the description of the surfactant (iii)(a). In one embodiment $R^1$ is derived from a polyisobutene. The group $R^1$ may have a number average molecular weight in the range of about 200 to about 5000, and in one embodiment in the range of about 500 to about 2300.

The aldehyde or ketone may be represented by the formula (iii)(c)-2

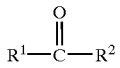

or a precursor thereof; wherein in Formula (iii)(c)-2: $R^1$ and $R^2$ independently are H or hydrocarbon groups having from 1 to about 18 carbon atoms. $R^1$ and $R^2$ may be hydrocarbon groups containing 1 to about 6 carbon atoms, and in one embodiment 1 or 2 carbon atoms. In one embodiment, $R^1$ and $R^2$ may be independently phenyl or alkyl-substituted phenyl groups having up to about 18 carbon atoms. $R^2$ can also be a carbonyl-containing hydrocarbon group of 1 to about 18 carbon atoms. Examples include formaldehyde, acetaldehyde, benzaldehyde, methyl ethyl ketone, glyoxylic acid, and the like. Precursors of such compounds can be used. These include paraformaldehyde, formalin, trioxane, and the like.

The amine may be any of the amines described in the description of the surfactant (iii)(a) above having at least one >N—H or —$NH_2$ group. The amine may be a monoamine, a polyamine or a hydroxyamine.

The ratio of moles of hydroxy aromatic compound to aldehyde or ketone to amine may be about 1:(1 to 2):(0.5 to 2).

Surfactant (iii)(d)

The surfactant (iii)(d) is at least one ionic or nonionic compound having a hydrophilic lipophilic balance (HLB) in the range of about 1 to about 40, and in one embodiment about 1 to about 20, and in one embodiment about 1 to about 10. Examples of these compounds are disclosed in McCutcheon's Surfactants and Detergents, 1998, North American & International Edition. Pages 1–235 of the North American Edition and pages 1–199 of the International Edition are incorporated herein by reference for their disclosure of such ionic and nonionic compounds. Useful compounds include alkylaryl sulfonate, amine oxide, carboxylated alcohol ethoxylate, ethoxylated amine, ethoxylated amide, glycerol ester, glycol ester, imidazoline derivative, lecithin, lecithin derivative, lignin, lignin derivative, monoglyceride, monoglyceride derivative, olefin sulfonate, phosphate ester, phosphate ester derivative, propoxylated fatty acid, ethoxylated fatty acid, propoxylated alcohol or alkyl phenol, sucrose ester, sulfonate of dodecyl or tridecyl benzene, naphthalene sulfonate, petroleum sulfonate, tridecyl or dodecyl benzene sulfonic acid, sulfosuccinate, sulfosuccinate derivative, or mixture of two or more thereof. These compounds typically contain a hydrocarbon group having at least about 8 carbon atoms, and in one embodiment at least about 12 carbon atoms.

In one embodiment, the surfactant (iii)(d) is a poly (oxyalkene) compound. These include copolymers of ethylene oxide and propylene oxide. In one embodiment, the surfactant (iii)(d) is a copolymer represented by the formula

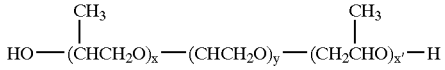

wherein x and x' are the number of repeat units of propylene oxide and y is the number of repeat units of ethylene oxide, as shown in the formula. In one embodiment, x and x' are independently numbers in the range of zero to about 20, provided that x or x' is at least 1, and y is a number in the range of about 4 to about 60. In one embodiment, this copolymer has a number average molecular weight of about 1800 to about 3000, and in one embodiment about 2100 to about 2700.

In one embodiment, the surfactant (iii)(d) is an alkyl alcohol, alkyl amine, alkyl amide or alkyl acid ester.

The Water-Soluble Nitrogen Containing Emulsion Stabilizer

The water-soluble nitrogen containing emulsion stabilizer may be a water-soluble amine, or a water-soluble nitrate, nitro or azide compound. These include urea, guanidine and ammonium bimalate. Also included are the amine or ammonium salts represented by the formula $$k[G(NR_3)_y]^{y+}nX^{p-}$$

wherein G is hydrogen or an organic group of 1 to about 8 carbon atoms, and in one embodiment 1 to about 2 carbon atoms, having a valence of y; each R independently is hydrogen or a hydrocarbon group of 1 to about 10 carbon atoms, and in one embodiment 1 to about 5 carbon atoms, and in one embodiment 1 to about 2 carbon atoms; $X^{p-}$ is an anion having a valence of p; and k, y, n and p are independently integers of at least 1. When G is H, y is 1. The sum of the positive charge $ky^+$ is equal to the sum of the negative charge $nX^{p-}$. In one embodiment, X is a nitrate ion; and in one embodiment it is an acetate ion. Examples include ammonium nitrate, methylammonium nitrate, urea nitrate, urea dinitrate, and the like.

In one embodiment, the water-soluble nitrogen containing emulsion stabilizer also functions as a combustion improver. Ammonium nitrate is a specific example of an emulsion stabilizer that also functions as a combustion improver. A combustion improver is characterized by its ability to increase the mass burning rate combustion improver is characterized by its ability to increase the mass burning rate of the fuel composition and improve the power output of the engine. Additional combustion improvers are discussed below.

The water-soluble nitrogen containing emulsion stabilizer may be present in the water blended fuel composition at a concentration of about 0.001 to about 10% by weight, and in one embodiment about 0.01 to about 5% by weight, and in one embodiment about 0.01 to about 2% by weight.

Cetane Improvers

The cetane improvers include peroxides, nitrates, nitrites, nitrocarbamates, and the like. Examples include nitropropane, 2-nitro-2-methyl-1-butanol, an the like. Also included are nitrate esters of substituted or unsubstituted aliphatic or cycloaliphatic alcohols which may be monohydric or polyhydric. These include substituted and unsubstituted alkyl or cycloalkyl nitrates having up to about 10 carbon atoms. The alkyl group may be either linear or branched. Examples include methyl nitrate, butyl nitrate, 2-ethylhexyl nitrate, and the like.

The concentration of the cetane improver in the water blended fuel composition may be at a level of up to about 10% by weight, and in one embodiment about 0.05 to about 5% by weight.

Combustion Improvers

The combustion improvers include strained ring compounds, nitro compounds, and certain hydroxyamines. Strained ring compounds are compounds containing cyclic rings of 3 to 5 atoms, and in one embodiment 3 to 4 atoms. The strained rings are typically saturated, but the 3 and 4 membered rings may contain olefinic unsaturation. The 5 membered rings do not contain olefinic unsaturation. The strained ring compounds may be monocyclic or polycyclic compounds. The polycyclic compounds may have fused ring systems, and/or ring systems connected directly or via a bridge group, and/or spiro-compounds. The polycyclic compounds may have, for example, from 2 to 4 rings. The rings may contain one or more heteroatoms (e.g., O, S or N). Typically the heterocyclic rings contains at least 2 carbon atoms and no more than 2 heteroatoms, and generally only 1 heteroatom. Examples of useful strained ring compounds include cyclopropyl methanol, cyclobutyl amine, cyclobutyl hydroxyamine, 3,3-dimethyloxetane, 1-methoxy-2-methylpropylene oxide, 2-methoxydioxolane and 2,5-dimethoxytetrahydrofuran.

The nitro compounds may be aliphatic or aromatic. They may contain one or more than one nitro group. The nitro compounds include purely hydrocarbon and substituted hydrocarbon compounds. Examples include nitromethane, nitropropane, dinitropropane, hydroxymethyl nitropropane, 1,3-dimorpholino-2-nitropropane, 1,2-dinitropropane, 2-methyl-2-nitropropane, bis(2-nitropropyl)methane, tetranitromethane, nitrobenzene, dinitrotolune, trinitrotoluene, and nitrated phenols (e.g., butyldinitrophenol).

The hydroxyamines useful as combustion improvers may be represented by the formulae

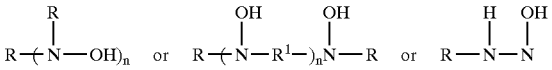

wherein each R is independently hydrogen or a hydrocarbyl group, $R^1$ is an alkylene group, and n is a number ranging from 1 to about 30. These types of hydroxyamines wherein the hydroxyl group is attached directly to the nitrogen are also known as hydroxylamines. Each R may be a primary or secondary hydrocarbyl group. Each R group may contain from 1 to about 25 carbon atoms, and in one embodiment 1 to about 8 carbon atoms. $R^1$ may be a lower alkylene group, and in one embodiment it is ethylene or a propylene group. n may range from 1 to about 10, and in one embodiment 1 to about 5. Salts of these hydroxyamines may also be used. The salts include nitrates, sulfates, sulfonates, carbonates and carboxylates. Examples of these hydroxyamines are disclosed in U.S. Pat. Nos. 3,491,151; 4,017,512; 5,731,462; 5,733,935; and 6,031,130, incorporated herein by reference.

The concentration of the combustion improver in the water blended fuel composition may range up to about 5% by weight, and in one embodiment about 0.005 to about 2% by weight.

Other Fuel Additives

In addition to the foregoing, other fuel additives that are well known to those of skill in the art may be used. These include antiknock agents, lead scavengers, ashless dispersants, deposit preventers or modifiers, dyes, antioxidants, rust inhibitors, bacteriostatic agents, gum inhibitors, metal deactivators, demulsifiers, upper cylinder lubricants, and the like. These fuel additives may be used at concentrations that typically range up to about 1% by weight for each additive based on the total weight of the water blended fuel composition, and in one embodiment about 0.01 to about 1% by weight.

Organic Solvent

The surfactant (iii), as well as other oil-soluble fuel additives (e.g., cetane improvers, dispersants, deposit preventers or modifiers, etc.), may be diluted with a substantially inert, normally liquid organic solvent such as mineral oil, kerosene, diesel fuel, synthetic oil (e.g., ester of dicarboxylic acid), naphtha, alkylated (e.g., $C_{10}$–$C_{13}$ alkyl) benzene, toluene or xylene to form an additive concentrate which is then mixed with the normally liquid hydrocarbon fuel and water. These concentrates generally contain from about 10% to about 90% by weight of the foregoing solvent. The water blended fuel composition may contain up to about 10% by weight organic solvent, and in one embodiment about 0.01 to about 5% by weight.

Antifreeze Agent

In one embodiment, the water blended fuel composition contains an antifreeze agent. The antifreeze agent may be an alcohol. Examples include ethylene glycol, propylene glycol, methanol, ethanol, and mixtures thereof. The antifreeze agent is typically used at a concentration sufficient to prevent freezing of the water used in the water blended fuel composition. In one embodiment, the concentration is at a level of up to about 10% by weight, and in one embodiment about 1 to about 5% by weight.

Process for Forming the Water Blended Fuel Composition

The normally liquid hydrocarbon fuel, water, surfactant, and optionally other ingredients as discussed above may be mixed under appropriate mixing conditions to form the desired water blended fuel composition. For water-in-oil emulsions, high shear mixing may be used. For micro-emulsions low or minimal shear mixing conditions may be used. The mixing may be conducted at a temperature in the range of about 0° C. to about 100° C., and in one embodiment about 10° C. to about 50° C.

Specific Embodiment

EXAMPLES 1 AND C-1

Two 1000-hour engine durability tests are conducted using an EGR-equipped diesel engine. One of the tests, Example 1, employs a water blended fuel composition and is representative of the invention. The other test, Example C-1, employs a conventional diesel fuel and is outside the scope of the invention. Example C-1 is provided for purposes of comparison.

The engine is a 4-cylinder, 4-cycle, 8.5 liter displacement, 16.5:1 compression ratio, 275 bhp-rated @ 2100 RPM, 890-ft torque rated @ 2100 RPM, turbo-charged, MK2E Series 50 EGR-equipped, compression ignited engine supplied by Detroit Diesel Corporation.

The engine is lubricated with an SAE 15W-40 grade heavy duty diesel engine oil employing an olefin-copolymer viscosity modifier in combination with a performance additive package in a Group II base oil. The engine oil meets the requirement of Global DHD-1 performance specification.

For each 1000-hour test, the engine is charged with 51.5 pounds of engine oil. A 33.5-minute break in sequence is run. The 1000-hour cycle test procedure is then commenced. A series of cyclic test steps are run every 720 seconds. The oil is changed every 200 hours with the last 200 hours being the exception. The oil is sampled periodically throughout the course of each test. Approximately 3.75 pounds of new oil are added at each 50-hour interval, except at oil changes. The oil samples are analyzed for soot loading and iron content.

The water blended fuel composition used in Example 1 has the following formulation:

| | Wt % |
|---|---|
| Diesel fuel | 77 |
| Deionized water | 20 |
| Chemical additive mixture | 3 |

The diesel fuel used in the water blended fuel composition has a flash point of 66–67° C. (ASTM D93–80); initial boiling point of 180–183° C., 50% distillation at 296C, and 90% distillation at 334° C. (ASTM D86–96); kinematic viscosity at 40° C. of 3.8–3.9 $mm^2$/sec (ASTM D445); sulfur content of 0.01% (ASTM D2622); total aromatic hydrocarbon content of 22.3–22.5% and polycyclic aromatic hydrocarbon content of 3.3–3.4% (ASTM D5186–96); API gravity of 0.8432 (ASTM 287–82), and cetane number of 53 (ASTM D976).

The following chemical additive mixture is used. This additive mixture contains three surfactants or emulsifiers corresponding to surfactant (iii)(a), ammonium nitrate, and 2-ethylhexyl nitrate.

| Ingredient | Wt. % |
|---|---|
| Ester/salt prepared by reacting polyisobutene (Mn = 2000) substituted succinic anhydride (ratio of succinic groups to polyisobutene equivalent weights = 1.7) with dimethylethanol amine at a molar ratio of 1:2. | 40.0 |
| Succinimide derived from polyisobutene (Mn = 1000) substituted succinic anhydride and ethylene polyamine mixture containing 15–25 weight percent diethylene triamine with the remainder being heavy polyamines having seven or more nitrogen atoms per molecule and two or more primary amines per molecule. | 19.8 |
| Ester/salt made by reacting hexadecenyl succinic anhydride with dimethylethanol amine at a molar ratio of 1:1.35. | 7.1 |
| 2-ethylhexyl nitrate. | 23.8 |
| Ammonium nitrate solution (54% by wt. $NH_4NO_3$ in water). | 9.3 |

The water blended fuel composition used in Example 1 is prepared using the following mixing procedure:

(1) The diesel fuel is added to a mixing tank.

(2) The chemical additive mixture is mixed and then added to the diesel fuel.

(3) The mixture of diesel fuel and chemical additives is mixed in the mixing tank for 10–15 minutes.

(4) A DR3–9P IKA high shear mixer is set to a flow rate of 25 gallons (94.75 liters) per minute with the mixture of diesel fuel and chemical additives being mixed in the mixer.

(5) Deionized water is blended with the mixture of diesel fuel and chemical additives by adding the deionized water to the high shear mixer on the suction side at a rate of one gallon per minute using an induction tube. Once the water addition is complete, the mixture of diesel fuel, chemical additives and deionized water is recycled through the high shear mixer 10 times to complete the preparation of the desired water-in-oil emulsion.

The water blended fuel composition used in Example 1 is a water-in-oil emulsion characterized by a continuous oil (or diesel fuel) phase, and a discontinuous aqueous phase. The discontinuous aqueous phase is comprised of aqueous droplets having a mean diameter of about 0.6–0.8 micron.

The diesel fuel used in Example C-1 is available from Phillips Chemical Company under the designation PC-9 Diesel Special Test Fuel OEPPC 901.

Plots of the soot loadings observed in the oil samples over the course of each test are provided in FIG. 1. The amount of soot in the oil is a measure of how well the oil is performing in the prevention of wear of engine components. The lower the amount of soot, the better the oil is performing. FIG. 1 indicates a significant improvement for Example 1 as compared to Example C-1.

Figure 2:
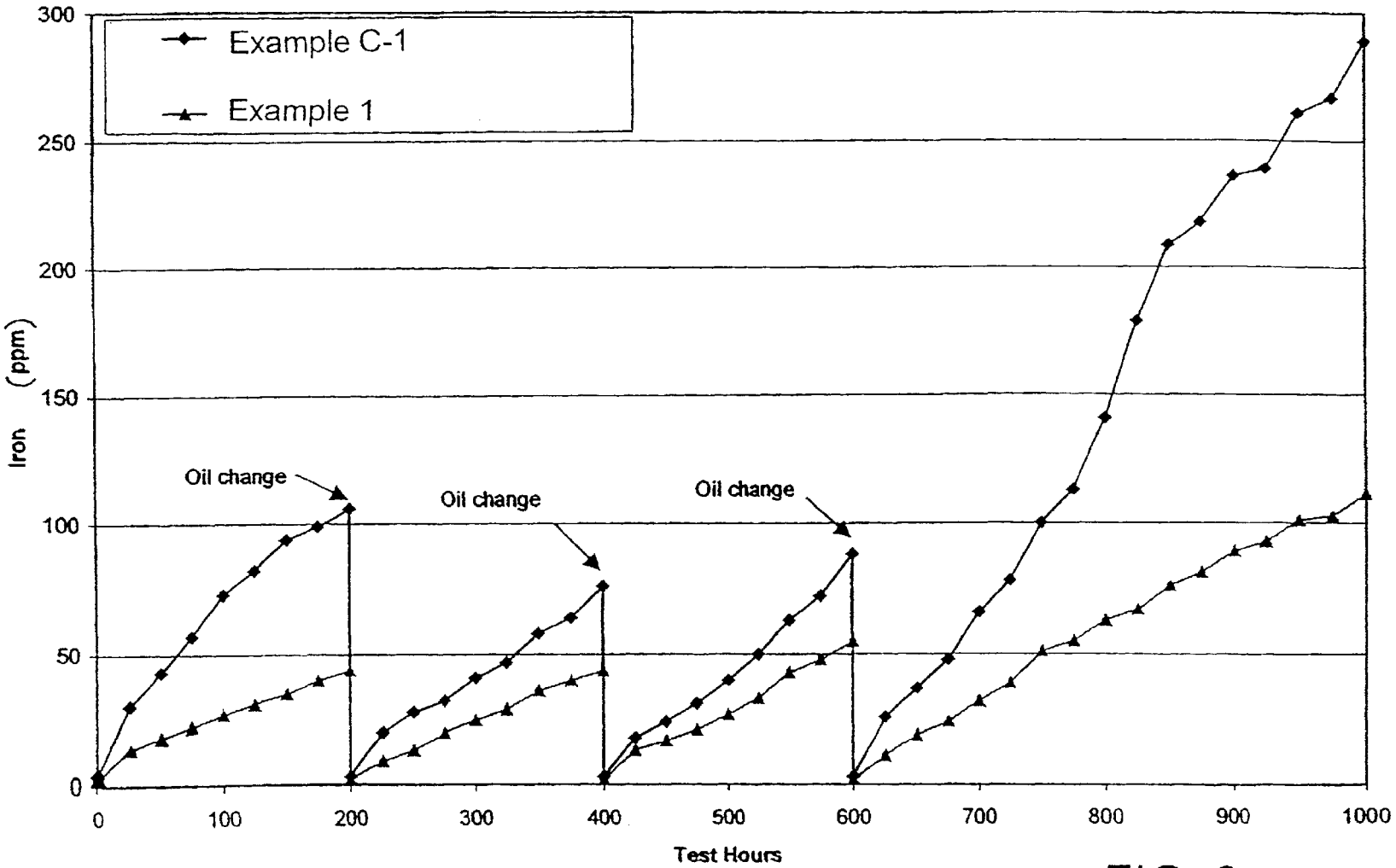
FIG. 2 is a plot of iron in the lubricant content versus test hours for the engine tests reported in Examples 1 and C-1.

Plots of residual iron found in the oil samples throughout the duration of each test are provided in FIG. 2. Higher levels of iron in an oil sample indicate higher levels of wear of metal parts in the engine. FIG. 2 indicates a significant improvement for Example 1 as compared to Example C-1.

Figure 3:
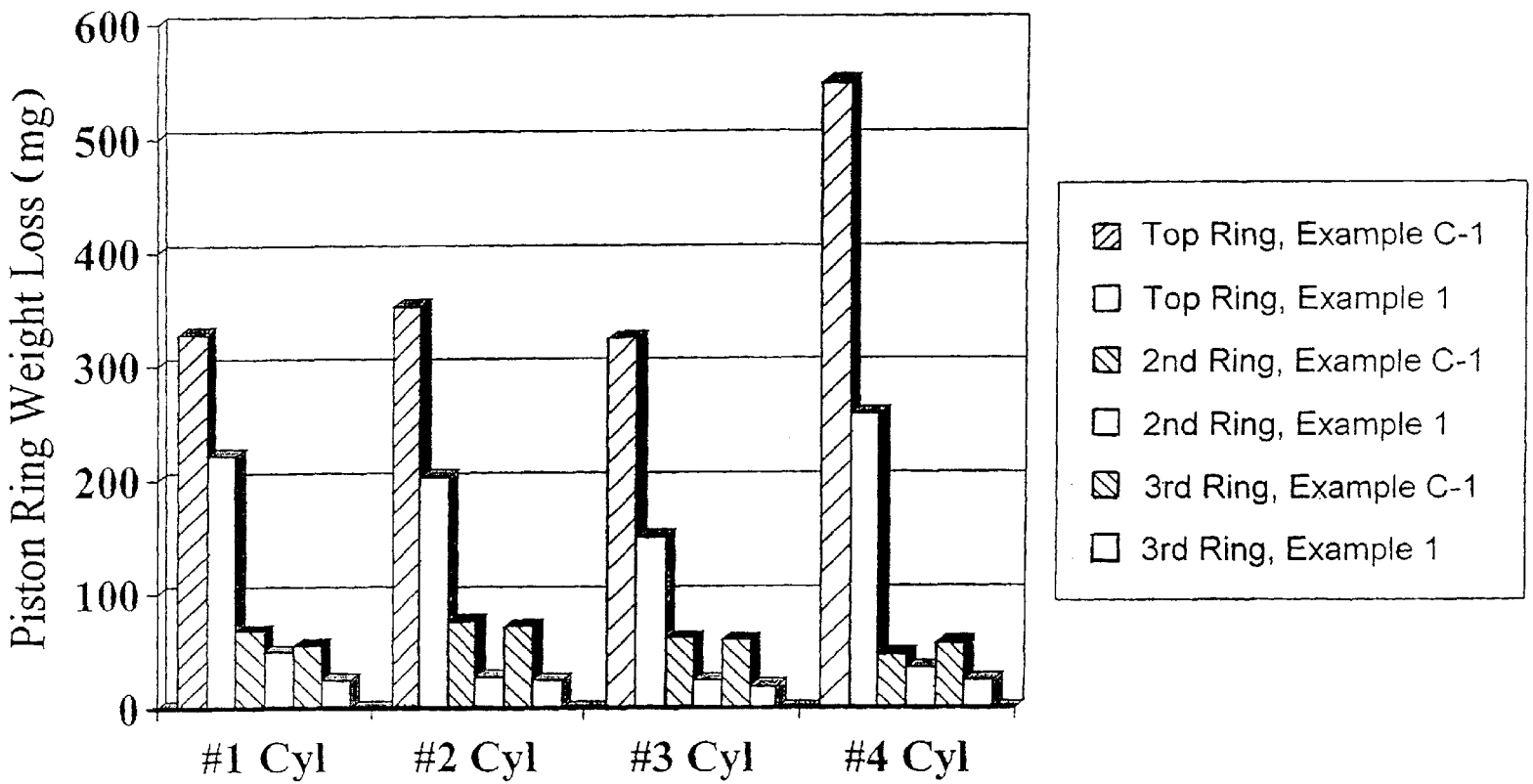
FIG. 3 is a graph showing piston ring weight loss for each of the four cylinders of the engine used in Examples 1 and C-1.

At the end of each test run, the engine is disassembled and cylinder-bore wear tests are run at the upper ring reversal area of each of the four cylinder liners using a Rank Taylor-Hobson, Form Talysurf profilometer. The results are provided in FIG. 3. These results indicate a significant improvement in wear reduction for Example 1 as compared to Example C-1.

Figure 4:
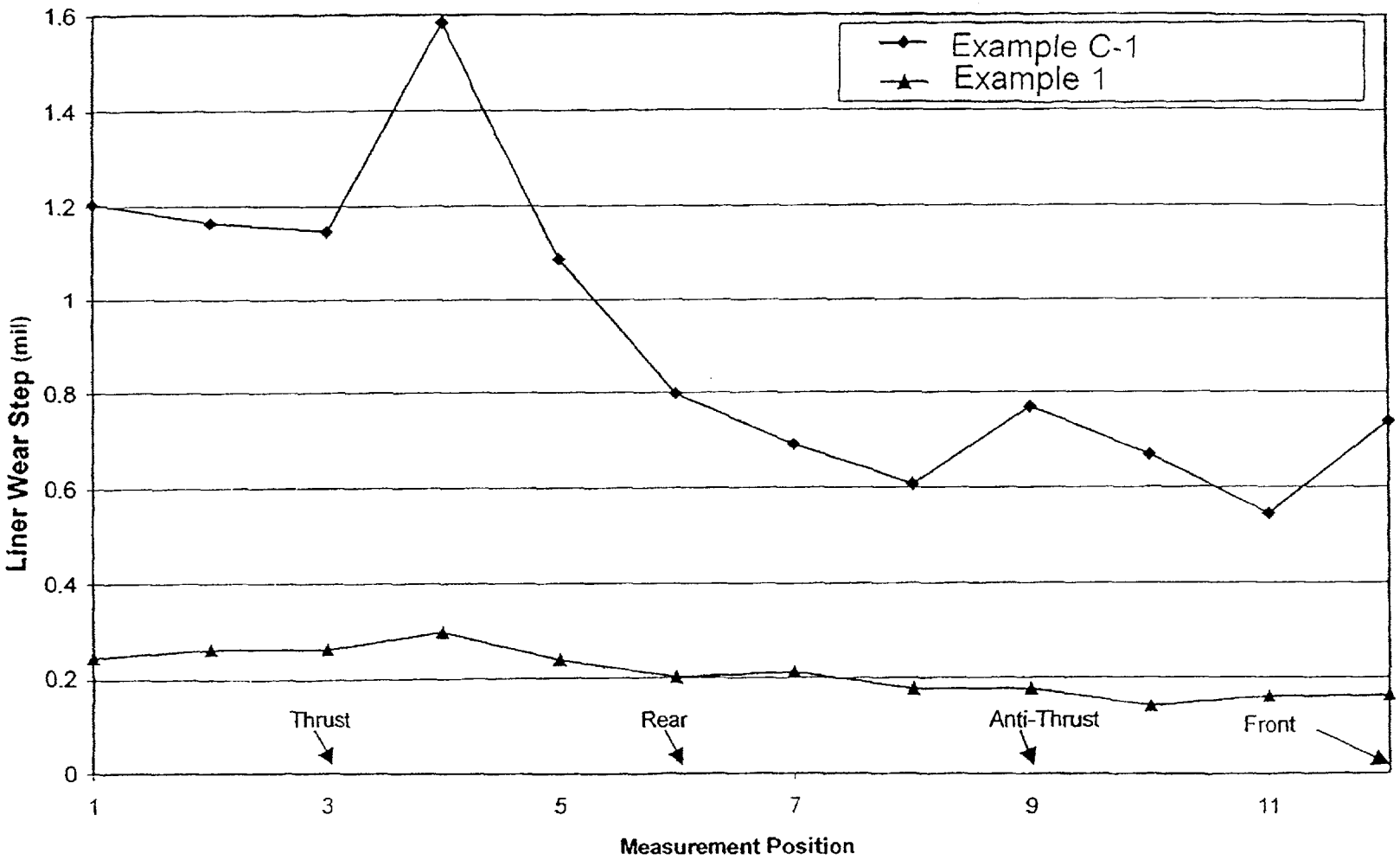
FIG. 4 is plot of liner wear versus measurement position for the cylinders of the engine used in Examples 1 and C-1.

Wear traces are run in twelve radial positions (similar to the hourly positions of a clock) for each of the four cylinders. The twelve-o'clock position is designated as the front of the engine as it is installed. The results are provided in FIG. 4, which is a plot of average wear for the four cylinder liners versus the measured position within the cylinder. These results indicate a significant improvement in wear reduction at each measured position for Example 1 as compared to Example C-1.

While the invention has been explained in relation to specific embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for reducing engine wear in the operation of an internal combustion engine, comprising:

(A) recirculating at least part of the exhaust gas from the engine to the intake air supply of the engine; and (B) operating the engine using a water-blended fuel composition made by combining:

(i) a normally liquid hydrocarbon fuel;

(ii) water; and (iii) at least one surfactant comprising:

(iii)(a) at least one product made from the reaction of an acylating agent with ammonia, an amine, a hydroxyamine, an alcohol, or a mixture of two or more thereof;

(iii)(b) at least one product derived from: a polycarboxylic acylating agent; a copolymer derived from at least one olefin monomer and at least one alpha, beta unsaturated carboxylic acid or derivative thereof; and a linking compound having two or more primary amino groups, two or more secondary amino groups, at least one primary amino group and at least one secondary amino group, at least two hydroxyl groups, or at least one primary or secondary amino group and at least one hydroxyl group;

(iii)(c) at least one Mannich reaction product derived from a hydroxy aromatic compound, an aldehyde or a ketone, and an amine containing at least one primary or secondary amino group;

(iii)(d) at least one ionic or a nonionic compound having a hydrophilic-lipophilic balance of about 1 to about 40; or (iii)(e) mixture of two or more of (iii)(a) through (iii)(d).

2. The process of claim 1 wherein the internal combustion engine is a compression ignition engine and the normally liquid hydrocarbon fuel is a diesel fuel.

3. The process of claim 1 wherein the water blended fuel composition further comprises a water-soluble nitrogen containing emulsion stabilizer.

4. The process of claim 1 wherein the water blended fuel composition further comprises an antifreeze agent.

5. The process of claim 1 wherein the water blended fuel composition further comprises a cetane improver.

6. The process of claim 1 wherein the water blended fuel composition further comprises a combustion improver.

7. The process of claim 1 wherein the water blended fuel composition further comprises an organic solvent.

8. The process of claim 1 wherein the surfactant (iii)(a) is the product made by the reaction of a polyisobutene-substituted succinic acid or anhydride with an alkanol amine or an alkylene polyamine.

9. The process of claim 1 wherein surfactant (iii)(a) comprises a mixture of: the product made from the reaction of a polyisobutene-substituted succinic acid or anhydride with an alkanol amine wherein the polyisobutene group has a number average molecular weight of about 1500 to about 3000; the product made from the reaction of a hydrocarbon-substituted succinic acid or anhydride with an alkanol amine wherein the hydrocarbon substituent has about 12 to about 30 carbon atoms; and the product made from the reaction of a polyisobutene-substituted succinic acid or anhydride with at least one alkylene polyamine wherein the polyisobutene group has a number average molecular weight of about 750 to about 1500.

10. The process of claim 1 wherein the surfactant (iii)(b) is comprised of a polyisobutene-substituted succinic anhydride and a copolymer derived from an alpha-olefin and maleic anhydride, the anhydride and the copolymer being linked together by an ethylene polyamine.

11. The process of claim 1 wherein the surfactant (iii)(c) is a Mannich reaction product derived from:

(iii)(c)(i) a hydroxy aromatic compound having the formula (iii)(c)-1

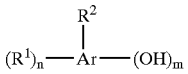

wherein in Formula (iii)(c)-1: Ar is an aromatic group; m is 1, 2 or 3; n is a number from 1 to about 4; with the proviso that the sum of m and n is less than the number of available positions on Ar that can be substituted; each $R^1$ independently is a hydrocarbon group of up to about 400 carbon atoms; and $R^2$ is H, amino or carboxyl;

(iii)(c)(ii) an aldehyde or ketone having the formula (iii)(c)-2

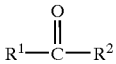

or a precursor thereof; wherein in Formula (iii)(c)-2: $R^1$ and $R^2$ independently are H or hydrocarbon groups having from 1 to about 18 carbon atoms; and $R^2$ can also be a carbonyl-containing hydrocarbon group having from 1 to about 18 carbon atoms; and (iii)(c)(iii) an amine containing at least one primary or secondary amino group.

12. The process of claim 1 wherein the surfactant (iii)(d) comprises an alkylaryl sulfonate, amine oxide, carboxylated alcohol ethoxylate, ethoxylated amine, ethoxylated amide, glycerol ester, glycol ester, imidazoline derivative, lecithin, lecithin derivative, lignin, lignin derivative, monoglyceride, monoglyceride derivative, olefin sulfonate, phosphate ester, phosphate ester derivative, propoxylated fatty acid, ethoxylated fatty acid, propoxylated alcohol or alkyl phenol, sucrose ester, sulfonate of dodecyl or tridecyl benzene, naphthalene sulfonate, petroleum sulfonate, tridecyl or dodecyl benzene sulfonic acid, sulfosuccinate, sulfosuccinate derivative, or mixture of two or more thereof, each of these compounds having a hydrocarbon group of at least about 8 carbon atoms.

13. The process of claim 1 wherein the surfactant (iii)(d) comprises a copolymer represented by the formula $$HO-(\overset{CH_3}{\overset{|}{C}}HCH_2O)_x-(CHCH_2O)_y-(CH_2\overset{CH_3}{\overset{|}{C}}HO)_{x'}-H$$

wherein x and x' are independently numbers in the range of zero to about 20, provided that x or x' is at least 1, and y is a number in the range of about 4 to about 60.

14. The process of claim 3 wherein the water-soluble nitrogen containing emulsion stabilizer is ammonium nitrate.

15. The process of claim 1 wherein the engine wear reduction is comprised of piston ring wear reduction or cylinder liner wear reduction.

* * * * *